US009255040B1

(12) United States Patent
Shaw et al.

(10) Patent No.: US 9,255,040 B1
(45) Date of Patent: Feb. 9, 2016

(54) BORON CARBIDE PYROTECHNIC TIME DELAY

(71) Applicants: Anthony P. Shaw, Madison, NJ (US); Jay C. Poret, Sparta, NJ (US); Christopher M. Csernica, Port Murray, NJ (US)

(72) Inventors: Anthony P. Shaw, Madison, NJ (US); Jay C. Poret, Sparta, NJ (US); Christopher M. Csernica, Port Murray, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 15 days.

(21) Appl. No.: 14/325,613

(22) Filed: Jul. 8, 2014

(51) Int. Cl.

| | |
|---|---|
| ***C06B 43/00*** | (2006.01) |
| ***C06B 29/14*** | (2006.01) |
| ***C06B 45/06*** | (2006.01) |
| ***C06B 45/22*** | (2006.01) |
| ***C06B 45/10*** | (2006.01) |

(52) U.S. Cl.
CPC ..... *C06B 43/00* (2013.01); *C06B 29/14* (2013.01); *C06B 45/06* (2013.01); *C06B 45/10* (2013.01); *C06B 45/22* (2013.01)

(58) Field of Classification Search
CPC ..... C06B 43/00; C06B 45/22; C06B 45/06; C06B 45/10
See application file for complete search history.

(56) References Cited

U.S. PATENT DOCUMENTS

| | | | | |
|---|---|---|---|---|
| 3,507,719 | A * | 4/1970 | Hodgson | C06B 27/00 149/11 |
| 4,820,362 | A * | 4/1989 | Baldi | B65D 43/022 149/109.6 |
| 8,282,749 | B1 * | 10/2012 | Sabatini | C06B 33/04 149/109.2 |

* cited by examiner

*Primary Examiner* — Aileen B Felton
(74) *Attorney, Agent, or Firm* — Henry S. Goldfine

(57) ABSTRACT

A precise, slow burning, pyrotechnic delay composition composed of a ternary system of from about 8 to about 55 weight percent $B_4C$ fuel, 35 to about 82 weight percent $NaIO_4$ oxidizer, and PTFE which acts as a pyrotechnic oxidizer and lubricant—such that the resulting composition has surprisingly good mechanical properties, i.e. it can be pressed to a desirably high consolidated density with ordinary loading force, and with minimal wear on the tooling used for pressing.

11 Claims, 3 Drawing Sheets

Inverse burning rates (s/cm, closed circles) and %TMD (open circles) for $x/(90-x)/10$ mixtures of $B_4C/NaIO_4/PTFE$.

Figure 1. Inverse burning rates (s/cm, closed circles) and %TMD (open circles) for $x/(90-x)/10$ mixtures of $B_4C/NaIO_4/PTFE$.

Figure 2. Inverse burning rates (s/cm, closed circles) and %TMD (open circles) for 15/(85−*x*)/*x* mixtures of $B_4C/NaIO_4/PTFE$.

Figure 3. Inverse burning rate (s/cm, closed circles) and %TMD (open circles) as functions of loading pressure. Data is shown for a 15/75/10 mixture of $B_4C/NaIO_4/PTFE$.

BORON CARBIDE PYROTECHNIC TIME DELAY

FEDERAL RESEARCH STATEMENT

The inventions described herein may be manufactured, used and licensed by, or for, the U.S. Government, for U.S. Government purposes.

BACKGROUND OF INVENTION

1. Field of the Invention

The present invention relates to precise, slow burning, pyrotechnic time delay compositions, and more particularly, to such compositions that are based upon environmentally friendly materials including boron carbide.

2. Background Art

Pyrotechnic delays provide reproducible time intervals between energetic events and are especially useful in munitions and military signals, including hand-held signals (HHS). While such delays have been replaced by very precise electronic time delays in advanced munitions, the simplicity and low cost of pyrotechnic delays is advantageous for mass produced and inexpensive munition components—such as, fuzes for hand grenades and delay elements for battlefield signal devices. Currently, such devices typically use relatively slow burning delay compositions which include a tungsten based delay formulation ($W/BaCrO_4/KClO_4$/diatomaceous earth), a manganese based formulation ($Mn/BaCrO_4/PbCrO_4$), a zirconium-nickel based formulation (Zr—Ni alloy/$BaCrO_4/KClO_4$), or what is termed a T-10 formulation ($B/BaCrO_4$). While these delay compositions are effective and have been proven over years of use, the heavy metals, chromates, and perchlorates they contain are known to be toxic. Further, these prior art compositions are generally abrasive and it is difficult to press them to the desired high consolidated density required for an efficacious delay column with minimal void space, i.e. a delay column with mechanical integrity—without the use of excessive pressure and excessive wear of the production tooling.

Generally, the performance of pyrotechnic delays is sensitive to many factors, including component particle size, mixture stoichiometry, loading density and procedures, and the configuration of the housing of the device in which the pyrotechnic delay is used. Seemingly subtle differences in materials and methodology can cause significant changes to the resulting time delay. As a result, many military delay composition specifications are written broadly, and precise compositions are not assigned specific burning rates. Instead the key trends are mapped, so that the manufacturers can obtain the desired burning rate range, while empirically adjusting for specific loading procedures and lot-to-lot differences in raw materials.

Critically, military munition and signal time delays involve the packing/pressing of typically, a precisely, slow burning pyrotechnic material within a relatively short, small diameter channel or cavity, which is bored in a relatively large ruggedized housing, typically made from aluminum or zinc alloys. Such configurations are hereinafter referred to in this application as the pyrotechnic material being "pressed into a consolidated column" or simply "consolidated." Aluminum and zinc alloys have very high thermal conductivity and thermal effusivity; where, thermal effusivity is a measure of a material's ability to transfer heat to its surroundings. Housings of such materials, with such high thermal conductivity and thermal effusivity—are effective heat sinks, which tend to quench slow burning delay compositions, halting the pyrotechnic reaction's propagation and thereby defeating the delay's functionality. Further, the HHS delay housing in particular is an especially large pancake-shaped aluminum disk with a very short and narrow channel—resulting in increased thermal losses, and further retarding the reaction's propagation, and thus further defeating the delay's functionality. The dimensions of the HHS delay housing may not be easily or practically changed to avoid these problems, as said housing doubles as a structural element of the HHS rocket, in addition to housing the pyrotechnic delay composition.

Prior published work, disclosed a new pyrotechnic delay system containing W, $Sb_2O_3$, $KIO_4$, and calcium stearate for use in U.S. Army hand-held signals, that was functional in the large pancake-shaped HHS aluminum delay housing, and reliably gave desirable, relatively long, burning times of 5-6 s, 7-8.5 s/cm (wherein s/cm is an inverse burn rate, "IBR"—which is a preferred performance metric for slow-burning delay compositions, as subtle differences in low rates are easily distinguished when this reciprocal rate data is plotted). See, Poret et al., "Development and Performance of the $W/Sb_2O_3/KIO_4$/lubricant Pyrotechnic Delay in the U.S. Army Hand-Held Signal", *Propellants, Explosives, Pyrotechnics*, vol. 38, pp. 35-40, 2013. However, although the antimony oxide in this $W/Sb_2O_3/KIO_4$/calcium stearate delay is arguably less hazardous than the $BaCrO_4$ it replaced, such antimony compounds themselves are a health and environmental concern.

Therefore, there is a need in the art for a new, replacement pyrotechnic delay composition, which is nonabrasive, easily pressed and useful in military munitions and signals, that does not contain any environmentally hazardous materials, such as heavy metals, chromates, and perchlorates; that will burn hot enough, so as not to be quenched by heat losses to delay housings; while burning slow enough, to provide the required, relatively long, delay burn time (considering the very short burn path in the subject devices); and where the various variables that impact the delays performance are controllable.

SUMMARY OF INVENTION

The present invention overcomes the above detailed problems of the prior art—the present invention being a ternary pyrotechnic delay system composed of a mixture of $B_4C$ (boron carbide), $NaIO_4$ (sodium periodate), and PTFE (polytetrafluoroethylene). Wherein boron carbide is an environmentally benign hard ceramic material, with a high melting point which acts as the fuel in the inventive pyrotechnic composition. And, wherein, $NaIO_4$, a periodate salt, acts as an oxidizer; but, unlike the commonly used oxidizer potassium perchlorate, $KClO_4$, $NaIO_4$ is not subjected to strict regulation and does not pose the same health and environmental hazards. And, finally, wherein, PTFE is a pyrotechnic oxidizer and a lubricant; which, surprisingly in the present formulation, allows the subject PTFE containing composition to advantageously be pressed to a very high consolidated density with minimal loading force and with minimal wear on the tooling used for the pressing/compaction.

The present inventive $B_4C/NaIO_4$/PTFE composition exhibits repeatable, stable, inverse burning rates (IBR, s/cm) from about 1.3 to about 20.8 s/cm when pressed into a consolidated column—encompassing the about 7 to about 8.5 s/cm range required for current military HHS. The particular desired IBR and packing efficiency for the subject composition can be controlled by varying the loading pressure, mixture stoichiometry, and component particle size—as detailed below. Further, advantageously, the subject composition is readily ignited by black powder, a typical igniter material that has a relatively low burning temperature and is used in current military HHS delay elements.

Additional features and advantages of the present invention will be set forth in, or are apparent from, the drawings and detailed description of preferred embodiments thereof which follows.

DETAILED DESCRIPTION OF THE INVENTION

The present invention is a ternary pyrotechnic delay system composed of from about 8 to about 55 weight percent of the $B_4C$ fuel, preferably, about 8 to about 40 weight percent $B_4C$ fuel; about 10 weight percent PTFE oxidizer and lubricant; and the balance $NaIO_4$ oxidizer—all of which ingredients are in powdered form, and wherein the various embodiments (alternative weight percentages of each ingredient, within the stated ranges) burned steadily, with little variation in IBR between samples having the same composition. Fuel-lean compositions of the ternary system, containing from about 5 to about 7.5 weight percent $B_4C$, failed to ignite, and if ignited did not propagate. Conversely, very fuel-rich compositions, containing about 60 percent $B_4C$ fuel, exhibited erratic behavior characterized by ignition failure, partial propagation, and high IBR variance for any samples that did propagate (e.g. 4.10 and 8.36 s/cm when pressed into a consolidated column). Compositions with greater than 60 weight percent $B_4C$ failed to ignite.

Useful in the present invention, are $B_4C$ powders (carbon rich, 19.0-21.7 weight percentage C) which were obtained from AEE (Atlantic Equipment Engineers, Inc., Upper Saddle River, N.J. 07458) and Alfa Aesar, Ward Hill, Mass. 01835. Sodium periodate was obtained from Alfa Aesar and was physically sieved into different fractions using US Mesh size 80, 200, and 325 screens—where, the −325 Mesh fraction is preferred. PTFE powders were obtained from AGC Chemicals, Exton, Pa. 19341, and DuPont, Wilmington, Del. 19807, and the AGC FL1650 PTFE powder is especially preferred—which is a finely milled PTFE with a typical 480 g/L bulk density, and a mean particle size of about 17 microns. These three ingredients were dry mixed to form the desired ternary pyrotechnic delay mixtures/compositions of the present invention. The mixing was done on a lab scale using a vibrating shaker, for a period of a few (i.e. about 3) minutes, until the material was thoroughly mixed to obtain a uniform distribution of the ingredients. The resulting mixture was visually inspected to remove any large aggregates (which, if present, were simply broken up by hand)—followed by another period of mixing (for another few, i.e. about 3 minutes), again, until uniform distribution of the ingredients was obtained. The final mixture was homogenous and provided the desired consistent and reproducible IBR.

Figure 1:
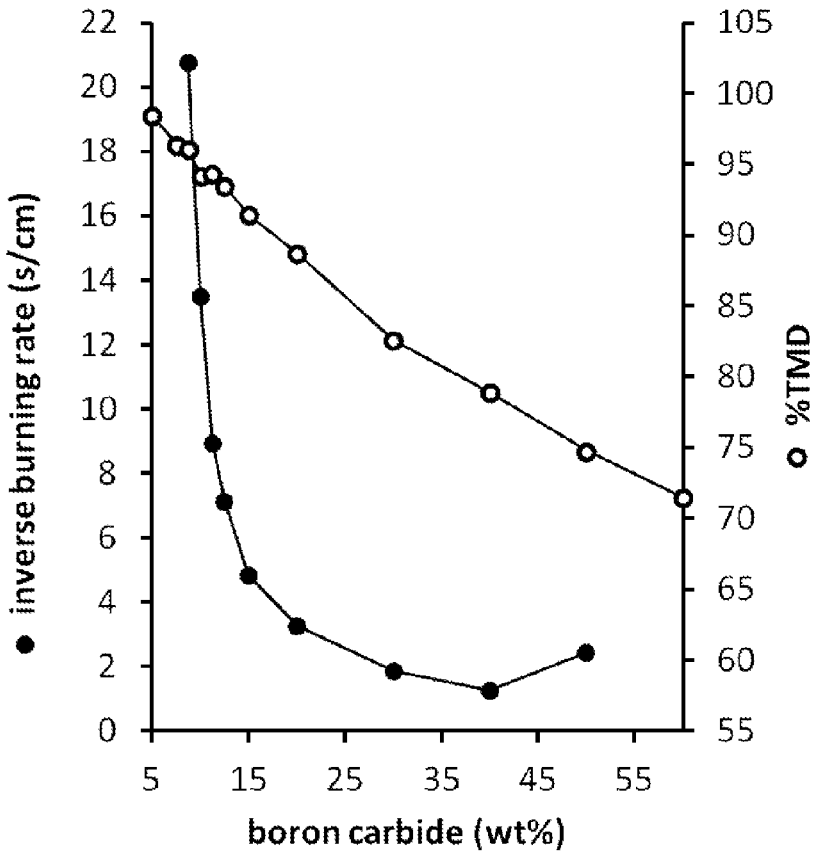
FIG. 1 is a graphic presentation showing inverse burning rates (s/cm, closed circles) and % TMD (open circles) for x/(90−x)/10 mixtures of $B_4C/NaIO_4$/PTFE as the weight percentage of $B_4C$ is altered in alternative embodiments of the present invention.

The IBR (s/cm) of alternative embodiments of the present invention, with varying quantities of the 3 ingredients, all pressed at 376.6 MPa, are shown in FIG. 1. Also shown in FIG. 1, for those same alternative embodiments, is the percentage of the theoretical maximum density (% TMD) for the pressed/consolidated delay columns. The particular alternate embodiment, i.e. composition, used in FIG. 1 is a preferred 1500 grit $B_4C$ fuel, −325 mesh $NaIO_4$, and PTFE, having a preferred mean particle size of about 17 micron. Further, all compositions were pressed at a preferred pressure of about 376.6 MPa. And, wherein the % TMD is the average density of the loaded charge as a percentage of the theoretical maximum density of the composition. In general, the relatively high % TMD load densities shown in FIGS. 1, 2, and 3 advantageously impart the delay columns with increased mechanical integrity. Further, such relatively high load densities, as shown in FIG. 1, also permit the use of more pyrotechnic composition, thereby increasing IBR—to the particular IBR's of the present invention.

Interestingly, the hockey stick-shaped IBR curve in FIG. 1 is similar to plots for other prior art pyrotechnic delay systems such as the prior art $W/BaCrO_4/KClO_4$/diatomaceous earth and $B/BaCrO_4$ delays. Generally, at sub-stoichiometric fuel levels the compositions exhibit both low exothermicity and low thermal conductivity, two complementary effects that give slow burning rates. While super-stoichiometric fuel levels are also associated with low exothermicity, thermal conductivity generally increases with increasing fuel content. These two effects compete and the IBR curves are therefore not as steep at the higher fuel levels. For the compositions in FIG. 1, packing efficiency is also affected by changes to boron carbide content. Even though the compositions were pressed at a constant loading pressure, % TMD decreased steadily as the $B_4C$ level increased. As one of the hardest materials known, boron carbide is used extensively in industry as an abrasive and this quality is not conducive to achieving high packing efficiencies. The IBR curve is therefore shaped by two effects—composition stoichiometry and packing efficiency.

Figure 2:
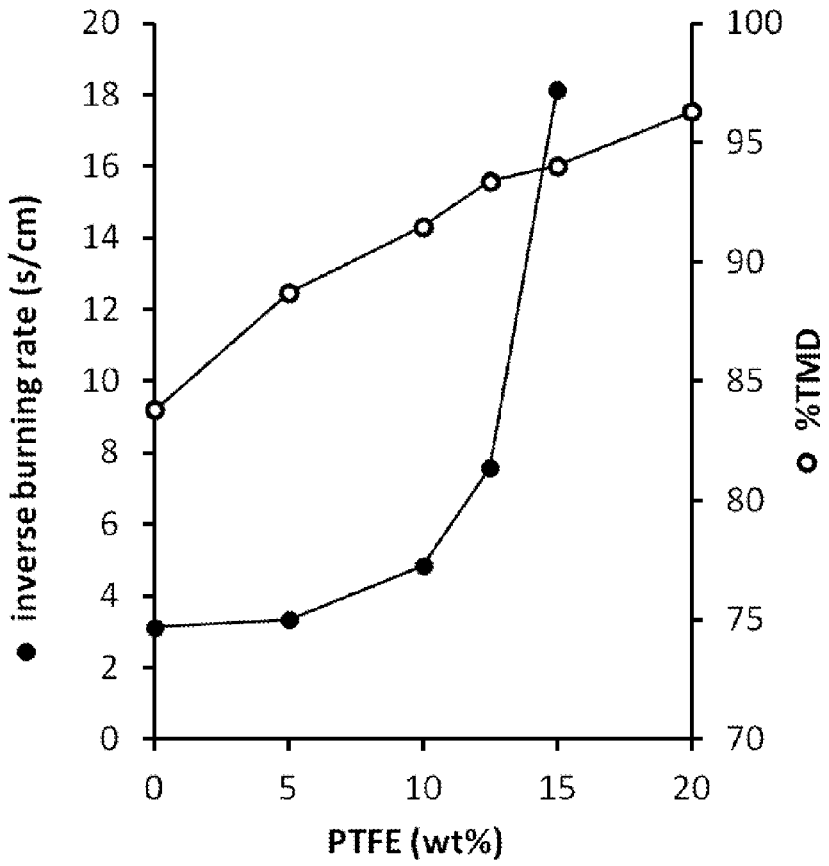
FIG. 2 is a graphical presentation of the effect of varying the weight percentage of the PTFE in the inventive formulations and the resulting inverse burning rates (s/cm, closed circles) and % TMD (open circles) for 15/(85−x)/x embodiments of the present ternary $B_4C/NaIO_4$/PTFE inventive composition.

Referring to FIG. 2, wherein the weight percentage of the PTFE in the inventive formulation is varied and the resulting IBR and % TMD is observed—for sample pressed at a constant 376.6 MPa. As can be seen, with $B_4C$ held constant at 15 wt %, the amounts of $NaIO_4$ and PTFE were varied. The binary $B_4C/NaIO_4$ composition burned at a relatively fast 3.13 s/cm and the introduction of just 10 wt % PTFE increased this IBR to a more desirable, slower 4.83 s/cm. Larger amounts of PTFE gave even larger increases in IBR until the compositions no longer ignited. Packing efficiency increased steadily as the PTFE level increased, a manifestation of this polymer's surprising lubricating properties and tendency to deform under pressure. Delay columns containing large amounts of PTFE are both thermally insulated and effectively packed. These two factors promote slow burning rates until, again, the combustion waves are no longer self-sustaining, i.e. fail to propagate.

Figure 3:
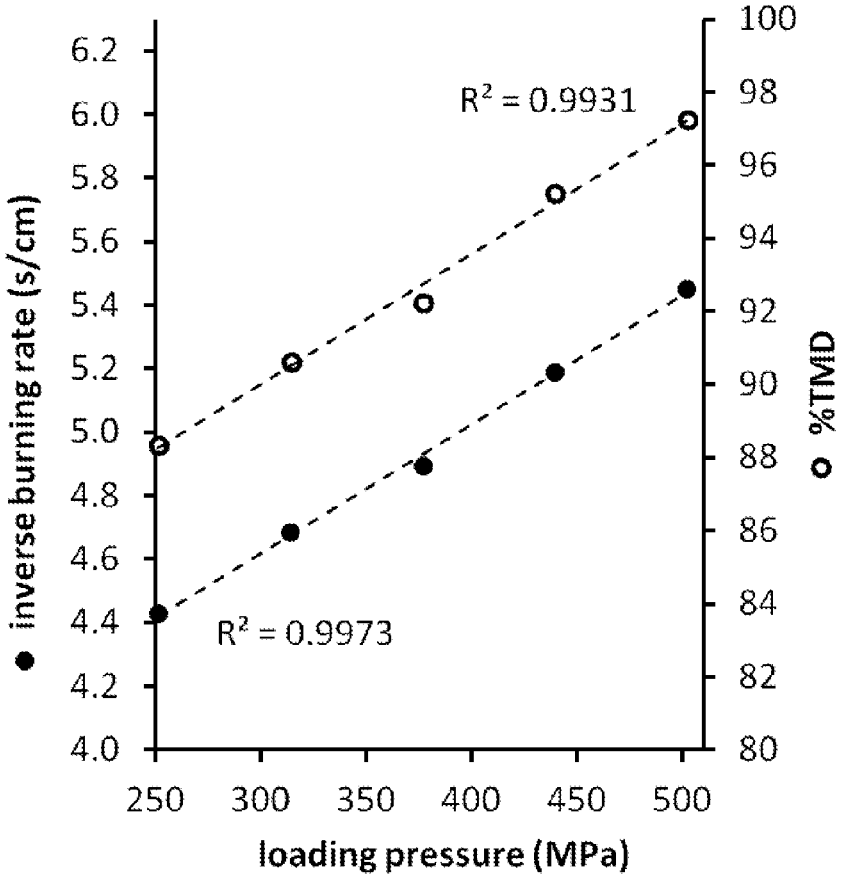
FIG. 3 is a graphical presentation of the effect of varying loading pressure on a respective 15/75/10 mixture of the present inventive $B_4C/NaIO_4$/PTFE pyrotechnic system—showing inverse burning rate (s/cm, closed circles) and % TMD (open circles).

Further, it was found that varying the loading pressure/force varied the burning rate of the subject pyrotechnic mixture. It is known that increased loading pressure results in greater packing efficiency (% TMD) and correspondingly less void space. In the subject relatively gassy (gas-producing) system, combustion gases migrate through void spaces ahead of the burning front, preheating un-burnt layers and accelerating the overall linear burning rate. However, the venting in typical HHS housings releases combustion gases and tends to mitigate such acceleration of burning, while using gas-producing delay compositions in non-vented or sealed delay housings will tend to give faster burning rates. Further, as shown in FIG. 3, varying loading pressure has a significant effect—as can be seen in this figure with a respective 15/75/10 mixture of the present inventive $B_4C/NaIO_4$/PTFE pyrotechnic system. Both IBR and % TMD varied linearly over 251-502 MPa (i.e. linearity of the inverse burning rate being an $R^2$=0.9973 and that of the % TMD being an $R^2$=0.9931). Importantly, the shown about 250 to about 500 MPa, loading pressures are relatively ordinary loading/compaction pressures—but the resulting % TMD, about 88 to about 98% TMD, are surprisingly high at such ordinary compaction pressures (due to the presence in the formulation of the PTFE lubricant). And, IBR varied by only ±10% about the center point (376.6 MPa, 4.89 s/cm) indicating a moderate sensitivity to changes in % TMD.

In general, the burning rate of a boron carbide-based pyrotechnic, such as the present invention, would be expected to be sensitive to variations in the fuel particle size. Various boron carbide samples, detailed in Table 1, below, were used to make delay elements with 15/75/10 and 20/70/10 mixtures of $B_4C/NaIO_4$/PTFE. As expected from the fuel level data shown in FIG. 1, the compositions containing 15 wt % $B_4C$ burned more slowly and had slightly greater packing efficiencies than their 20 wt % analogues—as shown in Table 2, below. Within each set of experiments, % TMD varied little and the differences in IBR may be attributed to the different $B_4C$ particle sizes. Delays containing fine $B_4C$ (entries 1a-3a and 1b-3b) burned rapidly while those containing coarser fuel burned much more slowly. Even though the $B_4C$ samples varied by only 8-10 μm, the resulting IBR varied by more than six fold.

TABLE 1

Particle size data for $B_4C$ samples.

| Sample - Number/Details | D[4, 3] [a)] | D[v, 0.1] [b)] | D[v, 0.5] [b)] | D[v, 0.9] [b)] |
|---|---|---|---|---|
| 1 [d)]. <10 μm | 5.35 | 1.59 | 5.02 | 8.77 |
| 2 [e)]. Mean 1500 grit | 5.09 | 1.79 | 4.64 | 8.99 |
| 3 [e)]. Mean 1200 grit | 5.19 | 1.82 | 4.69 | 9.16 |
| 4 [e)]. Mean 800 grit (A) | 16.62 | 2.54 | 9.24 | 36.74 |
| 5 [e)]. Mean 800 grit (B) | 14.12 | 7.87 | 13.71 | 20.23 |
| 6. mixture [c)] | 11.25 | 2.72 | 9.72 | 20.46 |

[a)] Volume-based mean diameter in μm.
[b)] D[v, x] is the diameter in μm that (100 · x)% of the volume distribution is below.
[c)] A 50:50 mixture of <10 μm and 800 grit (B);
[d)] available from Alfa Aesar, boron carbide 99+%;
[e)] available from AEE.

TABLE 2

Effect of varying $B_4C$ size. [a)]

| Entry | $B_4C$ Type (Lot) (Sources - see Table 1, above) | $B_4C$ Amount (wt %) | Consolidated Density (g/cm$^3$) | % TMD [b)] | Inverse Burning Rate (s/cm) | Inverse Burning Rate (s/g) |
|---|---|---|---|---|---|---|
| 1a | <10 μm | 15 | 3.095 | 92.02 | 4.52 (0.09) | 8.24 |
| 2a | 1500 grit | 15 | 3.077 | 91.47 | 4.83 (0.04) | 8.87 |
| 3a | 1200 grit | 15 | 3.116 | 92.65 | 5.10 (0.08) | 9.24 |
| 4a | 800 grit (A) | 15 | 3.191 | 94.88 | 12.80 | 22.64 |
| 5a | 800 grit (B) | 15 | 3.140 | 93.36 | 32.1 | 57.6 |
| 6a | mixture [d)] | 15 | 3.174 | 94.36 | 10.66 | 18.95 |
| 1b | <10 μm | 20 | 2.971 | 90.38 | 3.00 (0.11) | 5.69 |
| 2b | 1500 grit | 20 | 2.917 | 88.74 | 3.27 (0.06) | 6.32 |
| 3b | 1200 grit | 20 | 2.934 | 89.26 | 3.32 (0.06) | 6.38 |
| 4b | 800 grit (A) | 20 | 3.041 | 92.52 | 7.80 (0.13) | 14.47 |
| 5b | 800 grit (B) | 20 | 2.998 | 91.20 | 18.09 | 34.06 |
| 6b | mixture [d)] | 20 | 2.996 | 91.13 | 5.93 (0.12) | 11.18 |

[a)] For compositions containing 15 or 20 wt % $B_4C$, 10 wt % AGC FL1650 PTFE, and −325 mesh $NaIO_4$ as the balance. All compositions were pressed at 376.6 MPa. Standard deviations for values are given in parentheses.
[b)] Consolidated density as a percentage of theoretical maximum.
[c)] Out of five samples tested, three did not ignite, one partially propagated, and one fully propagated with a burning time of 21.7 seconds.

The IBR are better correlated with the amount of $B_4C$ fines than with particle size mean (compare the mean and 10th percentile values in Table 1 with the results in Table 2). The most striking example is provided by the two different lots of "800 grit" $B_4C$. Here, the (A) lot has a distinctly greater mean; but, much more fine material as indicated by the lower D[v, 0.1] value. Delay elements made with this lot burned much more rapidly than those made with the (B) lot. The amount of coarse particles as indicated by D[v, 0.9] does matter, but to a lesser degree. A mixture of the coarsest and finest $B_4C$ samples gave material comparable to the 800 grit (A) lot. This mixture had a similar amount of fines but substantially fewer coarse particles than the (A) lot, and therefore gave slightly faster-burning delay columns.

In contrast to the significant sensitivity to $B_4C$ particle size described above, variations in $NaIO_4$ and PTFE particle size were found to have a much smaller effect on inverse burning rate). Commercially obtained $NaIO_4$ had a broad particle size distribution and was separated into fractions by screening. These fractions were used to prepare delay elements with 15/75/10 and 20/70/10 mixtures of $B_4C/NaIO_4$/PTFE. Despite a threefold difference in particle size between the finest and coarsest fractions (52 μm versus 150 μm), the resulting inverse burning rates varied by only 30%. As expected, the compositions containing finer $NaIO_4$ burned more rapidly.

PTFE is commercially available in various particle sizes and morphologies. Samples from AGC Chemicals had relatively high bulk densities and consisted mainly of rounded particles, while DuPont 7C PTFE had a much lower bulk density due to its extremely fibrous nature. Two samples from AGC Chemicals consisted of sub-micron particles in clusters (approximately 5 μm), while all the other samples consisted of larger micron-sized particles. Delay elements were prepared with 15/80/5 and 15/75/10 mixtures of $B_4C/NaIO_4$/PTFE using these samples. Differences in particle morphology had no discernible influence on the resulting IBR, while particle size did have an effect. At the 5 wt % PTFE level, the finest (sub-micron) samples gave distinctly slower-burning compositions (4.94 and 5.61 s/cm versus 3.4 s/cm for micron-sized PTFE). At the 10 wt % level, these samples gave highly packed columns (98-99% TMD) that failed to ignite.

Although the invention has been described above in relation to preferred embodiments thereof, it will be understood by those skilled in the art that variations and modifications can be effected in these preferred embodiments without departing from the scope and spirit of the invention.

What is claimed is:

1. An environmentally friendly and easily compressed pyrotechnic delay composition, comprising:

a ternary mixture of $B_4C$ (boron carbide), $NaIO_4$ (sodium periodate), and PTFE (polytetrafluoroethylene);

which mixture has an inverse burning rate from about 1.3 to about 20.8 s/cm when pressed into a consolidated column.

2. The delay composition of claim 1, wherein the composition contains from about 8 to about 55 weight percent of the $B_4C$; about 10 weight percent PTFE; and the balance $NaIO_4$.

3. The delay composition of claim 2, whereupon when consolidated at 376.6 MPa results in a % TMD of about 70% to about 100%.

4. The delay composition of claim 1, wherein the composition contains from about 8 to about 40 weight percent $B_4C$ fuel; about 10 weight percent PTFE; and the balance $NaIO_4$.

5. The delay composition of claim 1, wherein the $B_4C$ is carbon rich, containing from 19.0 to 21.7 weight percent C.

6. The delay composition of claim 1, wherein the $B_4C$ is 1500 grit, the $NaIO_4$ is −325 mesh, and the PTFE has a typical bulk density of about 480 grams per liter and a mean particle size of about 17 microns.

7. The delay composition of claim 1, wherein the delay composition is relatively easily compressed to relatively high % TMD with relatively ordinary loading pressures.

8. The delay composition of claim 7, wherein the relatively high % TMD is from about 88 to about 98% TMD and the relatively ordinary loading pressures are from about 250 to about 500 MPa.

9. The delay composition of claim 1, wherein when the pyrotechnic delay composition can be consolidated with minimal wear on the tooling used for the consolidation.

10. The delay composition of claim 1, wherein composition has an inverse burning rate from about 7 to about 8.5 s/cm.

11. The delay composition of claim 1, which provides repeatable delays of from 7-8.5 s/cm when consolidated in a large pancake-shaped HHS aluminum delay housing.

* * * * *